US005410761A

United States Patent [19]

Connelly et al.

[11] Patent Number: 5,410,761

[45] Date of Patent: May 2, 1995

[54] VISOR DAZZLER

[76] Inventors: Darlene A. Connelly; Renee M. Connelly; Marie B. Connelly; Michelle M. Connelly; Christine M. Connelly, all of 12006 Thackeray Ct., Bowie, Md. 20720

[21] Appl. No.: 106,707

[22] Filed: Aug. 16, 1993

[51] Int. Cl.[6] ..... A42B 1/24

[52] U.S. Cl. ..... 2/195.1; 2/209.13; 2/918; 40/329

[58] Field of Search ..... 2/10, 175.1, 175.6, 2/181, 195.1, 195.6, 209.13, 209.14, 909, 918; 40/329; 283/74, 75, 81

[56] References Cited

U.S. PATENT DOCUMENTS

| | | | |
|---|---|---|---|
| 2,803,829 | 8/1957 | Tscharner | 2/181 |
| 4,653,775 | 3/1987 | Raphael et al. | 283/74 |
| 4,889,749 | 12/1989 | Ohashi et al. | 283/74 |
| 5,003,639 | 4/1991 | White | 40/329 |
| 5,233,703 | 8/1993 | Galka | 2/10 |
| 5,276,985 | 1/1994 | Halloran | 2/918 |

*Primary Examiner*—Clifford D. Crowder
*Assistant Examiner*—Diana L. Biefeld
*Attorney, Agent, or Firm*—Robert Holper

[57] ABSTRACT

A cap having a visor with diverse pictorial displays placed on an insert that is located on the top surface of the visor, the insert being protected by a plastic envelope fastened to the visor with a strip of hook and loop material. The envelope may be colored as well as having pictorial displays imprinted thereon and reenforced at its edges by a stitching of textile material or the envelope may be made of fabric and have diverse pictorial displays attached to the upper surface of the fabric. The equipment for pictorial displays may come in kit form.

4 Claims, 1 Drawing Sheet

VISOR DAZZLER

FIELD OF THE INVENTION

The present invention has to do with cap visors containing pictorial displays and in particular wherein the display is located on the visor member and the display is protected by a cover that slips over the visor or alternatively the display the display is located on the cover per se.

BACKGROUND OF THE INVENTION

Examples of hats or caps that have pictorial displays include U.S. Pat Nos. 882,648 1,196,823, 1,676,504, 2,425,701, 2,803,829, 4,985,935, and U.S. Pat. No. 5,136,726, 882,648 shows a hat having a brim. Fitting over the brim is a hat cover 20 hat includes a crown portion fitting over the hat band 15 and a brim portion 20*b* fitting over the brim. The hat cover is provided with a contracting string 21 that will hold the hat cover frictionally in connection with the hat. The cover including the brim portion is made of fabric with the brim cover portion having a plurality of floral designs on its upper surface. U.S. Pat. No. 1,196,823 depicts a hat made of vegetable fiber which has crochet like figures on both the brim and the crown. An exchangeable lining which can be colored, lies behind the crochet to change the appearance of the hat. U.S. Pat. No. 1,676,504 illustrates a hat having a brim and a crown, the brim being contacted with a colored decorative facing material that fits over the brim and has a reenforcing wire hoop at its outer edge while the inner edge of the facing material has a conical reenforcement that fits into the crown. U.S. Pat. No. 2,425,701 shows a protective covering for a cap having a visor. Both the crown and the visor have decorative features. The cap is made of fabric and the protective covering includes a front panel made of a water resistant transparent sheet material. Stitched to the front panel is a pocket whose upper surface is also made of transparent sheet while the undersurface of the pocket is made of fabric. The covering slips over the cap and affords protection against the elements, while allowing observation of the decorations on the front panel and the visor. U.S. Pat. No. 2,803,829 shows a picture cap having pockets in its crown. In the pockets are windows between which are vertical sections having slots. Through these windows are inserted photographs with backing and transparent panels. The transparent panels protect the pictures from the elements. U.S. Pat. No. 4,985,935 is a cap visor that has a display adapted for what is referred to as an upper visor member. The display is foldable so that it can be placed in a closed flat position over the lower visor member when not in use. U.S. Pat. No. 5,136,726 also shows a cap with a visor. On the visor are a number of hook elements on which decorative displays with corresponding hook elements can be placed. These displays may also be located on the crown also.

While the aforesaid patents show various designs for caps and hats, none of them shows the unique design of this invention. Furthermore, the design proposed herein has greater versatility, in that it permits quick change to a different pictorial display by merely unfastening the cover and placing a new insert in the visor or unfastening the cover and placing over the visor a different cover having the display attached thereto.

Accordingly it is an object of this invention to make a cap visor wherein the display means is located on the visor itself.

Another object of this invention is to provide a pictorial display on the visor with a transparent protective cover.

A further object of this invention is to locate an easily replaceable pictorial display on the visor which is protected by a transparent cover, fastened to the visor at its underside.

Still another object of this invention is to use a visor cover that can be colored and have decorative, pictorial displays imprinted on its face.

Additionally it is an object of the invention to provide a protective fiber cover for the visor on which pictorial displays are attached directly to the cover.

SUMMARY OF THE INVENTION

In brief the invention comprises a cap having a visor. Fitted to the contour of the visor is an insert of sturdy material overlaid with a thin peelable surface on which pictorial displays may be pasted or otherwise adhesively applied. Over the insert is slipped a contoured transparent plastic envelope which protects the insert. The envelope is releasably fastened to the underside of the visor and also holds the insert in place. The plastic envelope may be colored or imprinted with pictorial displays or both, or the envelope could be made of fabric and colored as well with the pictorial display applied to the fabric envelope, preferably by stitching.

DETAILED DESCRIPTION OF THE INVENTION

Figure 1:
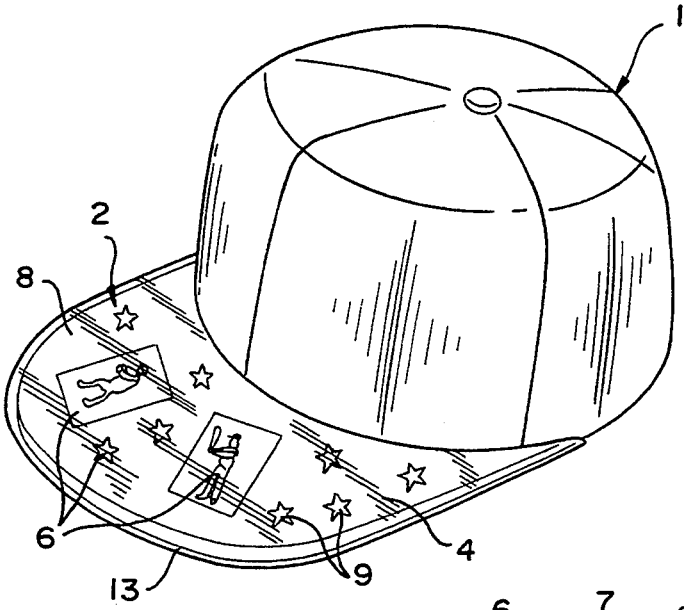
FIG. 1 is a top perspective view of a cap with a visor including a pictorial display on the visor.
Figure 2:
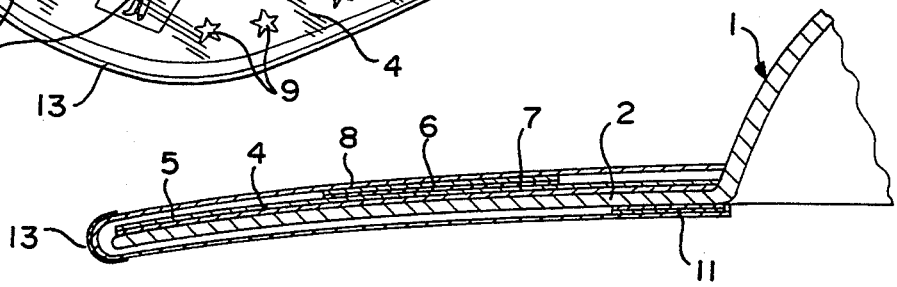
FIG. 2 is a sectional view along line 2—2 showing the insert and the envelope.
Figure 3:
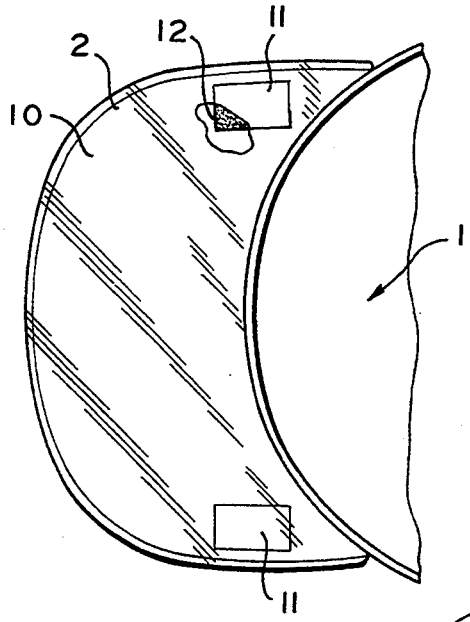
FIG. 3 is a bottom plan view showing the fastening of the envelope to the underside of the visor.
Figure 4:
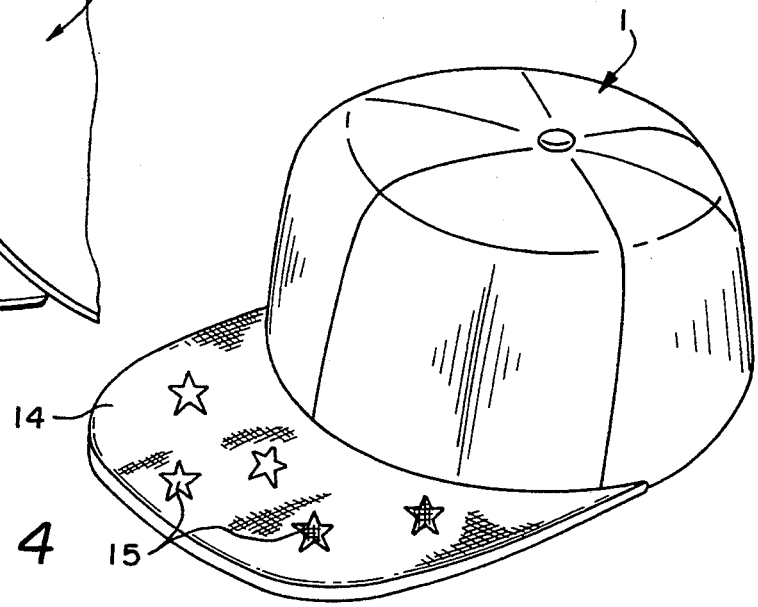
FIG. 4 is modification of FIG. 1 showing a visor with a fabric envelope with a pictorial display stitched onto the top surface of the fabric.

FIG. 1 shows what is described by the inventor as a Visor Dazzler, having a cap 1 with a visor 2 in the form of an arcuate surface extending from the crown. On the top of the visor is located an insert 4 contoured to the arcuate surface of the visor. The insert is made of flexible but sturdy material such as cardboard or plastic and is generally a solid white color. The insert is covered with a thin peelable layer 5 of cellophane or similar material. Adhered to the upper surface of the peelable layer can be a number of diverse pictorial displays 6 which can be chosen at the option of the cap wearer. For example a plurality of athletic events or players can be depicted, or if one is so inclined a number of aerodynamic events can be illustrated. The pictures are adhered to the cellophane upper surface by an adhesive 7 which is applied to the back of the pictures. To protect the pictorial display and hold it in place on the visor a plastic envelope 8 is slipped over the insert and visor. The envelope is preferably made of transparent plastic and is shaped to conform to the contoured surface of the visor and insert. The envelope is made from two identical shaped pieces of plastic which are bonded together to form the envelope. In another embodiment, in place of inserts with pictorial displays, the envelope itself might be colored or be imprinted with various pictorial displays 9 or it can be both colored and imprinted. As best seen in FIG. 3, on the undersurface 10 of the visor and adjacent to the region where the visor joins the crown of the cap there is fastened on each side a small strip of hook and loop material 11. The back side of the strip has an adhesive taped surface 12 which enables its sticking to the visor. Juxtaposed to these strips are corresponding strips of the same shape and size fastened on both sides of the envelope in the manner described above with respect to the visor. Accordingly, the insert is held secure to the visor and in the event one wishes to change the insert, the envelope can be readily moved by separating the strips. Because of wear it has been found that it is preferable to reinforce the bonded surface of the envelope with a reinforcing material of a fine textile 13 which is stitched to the bonded area. As stated above, the envelope can be colored or imprinted with a pictorial display or both imprinted and colored. This pictorial display can be used in conjunction with the display on the insert or may be used per se or with a blank insert. FIG. 4 shows a modification wherein the envelope is made of a fabric 14 and pictorial displays 15 is stitched or other fastened directly to the upper surface of the fabric envelope. The assembly may come in the form of a kit. The kit would contain a number of inserts, and a plurality of diverse pictorial displays. As well as being of different dimensions to accommodate different size visors, the kit would also contain a plurality of hook and loop fastener strips. The kit would be packaged with a sufficient number of pictorial displays so that a buyer would have ample opportunity to design the insert to suit; however, each kit would contain at the most five different type envelopes, one that is transparent, one colored, one having an imprinted display, one that is both colored and imprinted, and one that is made of fabric with pictorial displays attached to the upper surface of the envelope. Each kit would have different imprinted displays on the envelope.

The subject matter of this invention has been described, but it should be obvious to one skilled in the art that many modifications, substitutions or variations are possible in the light of the above teaching. It is therefore to be understood that within the scope of the appended claims the invention may be practiced otherwise than specifically described.

I claim:

1. A cap comprising a crown and a visor in the form of an arcuate member adjacent and secured to said crown, said visor having a top surface and an undersurface, an insert located on the top surface of the visor having a top and bottom side and being made of flexible but sturdy material, and having a thin layer of peelable plastic fixed on said top side, a plurality of varied pictorial displays adhesively secured to said peelable plastic, a transparent plastic envelope comprising a top sheet and a bottom sheet of symmetrical material, said sheets having outer edges and being bonded together on said outer edges and having an arcuate configuration that fits smoothly over said top surface and said undersurface of the visor and said insert, said sheets of said envelope extending to and adjacent said crown, said bottom sheet having a strip of hook and loop material fastened on each end of said sheet in the region where said sheet is adjacent said crown, a corresponding strip of hook and loop material fastened on said visor in the region where said visor is adjacent said crown, and so arranged that when said envelope is slipped over said visor, said strips of hook and loop material on said visor and said envelope will be in juxtaposted and fastening position.

2. A cap as in claim 1 wherein said bonded sheets of said envelope are reenforced by a fine textile material stitched (in the region of said bonding) at said bonded edges.

3. A cap as in claim 1 wherein said plastic envelope is colored and said strips have (a) back (side) sides, said (side) back sides covered with adhesive tape for fastening to said visor and said envelope.

4. A cap as in claim 3 wherein said plastic envelope has imprinted thereon a plurality of pictorial displays.

* * * * *